United States Patent [19]

Fender et al.

[11] Patent Number: 4,987,948

[45] Date of Patent: Jan. 29, 1991

[54] CASTING RING CRADLE

[75] Inventors: Covert E. Fender; Randy C. Wynn, Sr.; Vernon J. Miller, all of Carroll County, Ga.

[73] Assignee: Southwire Company, Carrollton, Ga.

[21] Appl. No.: 439,056

[22] Filed: Nov. 17, 1989

[51] Int. Cl.[5] ..... B22D 11/06

[52] U.S. Cl. ..... 164/433; 164/482

[58] Field of Search ..... 164/433, 434, 482

[56] References Cited

U.S. PATENT DOCUMENTS 4,465,120 8/1984 Smith et al. ..... 164/482

*Primary Examiner*—Kuang Y. Lin

*Attorney, Agent, or Firm*—James W. Wallis, Jr.; Stanley L. Tate

[57] ABSTRACT

An apparatus removably fastened to the casting wheel assembly of a continuous wheel and belt type casting machine which prevents damage to the copper mold member of said casting wheel apparatus when said member is removed from the continuous casting machine and placed on a hard horizontal surface.

8 Claims, 3 Drawing Sheets

CASTING RING CRADLE

TECHNICAL FIELD

This invention relates to the casting wheel assembly of a wheel and belt type continuous casting machine. More particularly, this invention is directed to an apparatus prevents deformation of the soft copper casting ring mould member of a casting wheel assembly when the assembly is removed from the casting machine and placed on a horizontal surface.

BACKGROUND ART

One method of manufacturing continuously cast copper product uses a wheel and belt type casting machine. The casting machine, or caster, comprises a rotating means for rotating a casting wheel assembly, the casting wheel assembly, and a continuous belt that rides on the surface of the wheel assembly.

The wheel assembly of a wheel and belt type caster comprises a mounting plate for mounting the assembly to the rotating means, a casting ring which has a groove machined into its periphery into which the molten metal is poured and solidified, and a side plate which is fastened to the mounting plate and casting ring to form the wheel assembly. The side plate and the mounting plate are typically fabricated from steel. The copper ring or casting insert is typically manufactured from copper or a copper base alloy. This copper or copper base alloy is soft and is susceptible to damage if force is applied to its periphery or to either of its two sides.

Typical industrial practice for removing the casting wheel assembly from the casting machine utilizes an overhead crane. A hook assembly is attached to the upper portion of the casting wheel assembly and the wheel assembly is removed from the casting machine. The vertically oriented wheel is then moved to a shop area where it is typically placed on the floor or some other work surface for maintenance or repair. However, most maintenance and repair procedures require that the wheel be positioned horizontally.

A typical one hundred twenty (120) inch casting wheel assembly weighs approximately 5400 pounds. Since the surface or periphery of the casting ring extends beyond the surface of the mounting plate and the side plate, the casting ring surface is exposed to the loads and forces directed toward or received by the surface of the casting wheel assembly. Even with careful crane operation, the copper ring can be damaged when the weight load of the assembly is concentrated on the small contact area between the soft copper ring and the floor or horizontal work surface on which it rests. When the wheel rests vertically on the floor horizontal surface, its entire 5400 pound weight load is concentrated on a very small area of the ring's periphery. This load is sufficient to warp the ring. The sides of the casting chamber can be deflected inwardly or outwardly or a flat spot can form on the outer surface of the casting ring. This damage will result in a poor seal between the band member and the copper ring. This poor seal allows molten metal to leak and leads to premature mould failure.

As the casting ring assembly is tilted over onto its side, up to half of its 5400 pound weight will rest on the corner of the casting ring that contacts the horizontal surface. This creates tremendous inward pressure on the mould ring which deflects the ring wall and results in damage to the casting chamber. The same type damage results when the casting ring is returned to an upright position from the horizontal position. The stresses on the mould are the same.

Careful attention on the part of the crane operator can minimize the damage to the soft copper casting rings; however, no degree of care can prevent damage to the ring. There is simply too much weight or load concentrated on too small an area.

DISCLOSURE OF THE INVENTION

It is therefore a primary object of the present invention to provide an apparatus which will prevent damage to the copper mould member of a casting wheel assembly when the assembly is removed from a casting machine and placed on a horizontal surface.

It is another object of the present invention to extend the useful life of the casting ring insert of a continuous casting wheel assembly.

It is another object of the present invention to provide an apparatus that will prevent damage to the casting ring insert when a casting wheel assembly is positioned upright on a hard horizontal surface.

The principal feature of the present invention is an apparatus that transfers the load applied to a casting wheel assembly from the surface and corners of the soft copper mould member of the assembly to the steel mounting wheel and steel backer plate, when such an assembly is positioned vertically on a horizontal surface.

Another feature of the present invention is its rocker base which allows the wheel assembly to be more easily tilted over onto its side while it is being placed on a horizontal surface.

Another feature of the present invention is the simplicity of the two bolt mounting mechanism which allows quick and easy attachment and removal.

Another feature of the present invention is the isolation of the soft casting ring member from any contact with the horizontal surface onto which the wheel assembly is placed and the resulting protection of the ring from load induced mechanical damage.

A principal advantage of the present invention is the ease of which damage to the casting ring is avoided.

Another advantage of the present invention is the extremely small cost involved with manufacturing the apparatus.

Another advantage of the present invention is the simplicity of using the apparatus to prevent damage to the copper casting ring member.

And another advantage of the present invention is the extended useful life of the casting ring resulting from reduced ring damage due to use of the present invention.

In accordance with these and other objects, features, and advantages there is provided an apparatus for protecting the soft copper casting ring from mechanical damage incurred when a casting wheel assembly is removed from a continuous casting machine and placed on a hard horizontal surface.

BEST MODE OF CARRYING OUT THE INVENTION

Figure 1:
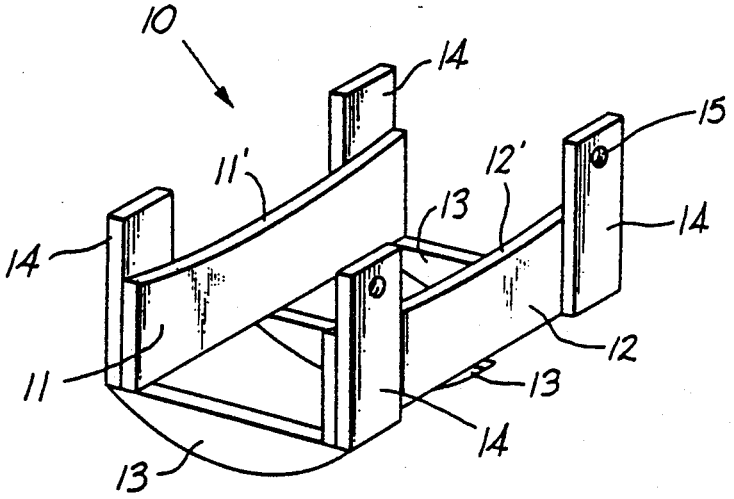
FIG. 1 is a pictorial view of the present invention as it would appear apart from a casting wheel assembly.

Refer now to FIG. 1 which is a pictorial view of the present invention. Casting ring assembly cradle 10 comprises two radiused support members 11, 12 with radiused support member contact surfaces being 11', 12', respectively. Support members 11, 12 are secured to a plurality of rocker members 13. Each of the plurality of rocker members 13 is substantially identical to other rocker members 13. Fastening members 14 are secured to support members 11, 12 such that when radiused support member contact surfaces 11', 12' contact surfaces 22', 23' respectively of mounting plate 22 and side plate 23 of casting ring assembly 20 (see FIG. 2) cradle 10 is secured to casting ring assembly 20 (see FIG. 2) by bolts (not shown) operating through threaded hole 15 in member 14.

Figure 2:
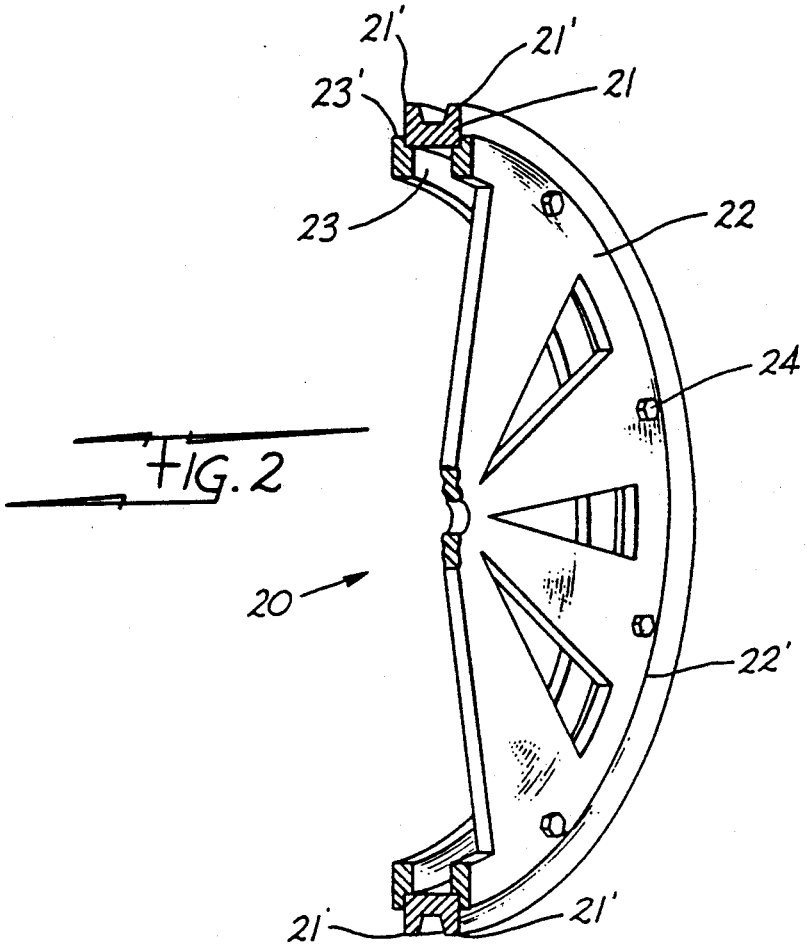
FIG. 2 and 2A, respectively is a rotated sectional view of a typical continuous casting wheel assembly.
Figure 2A:
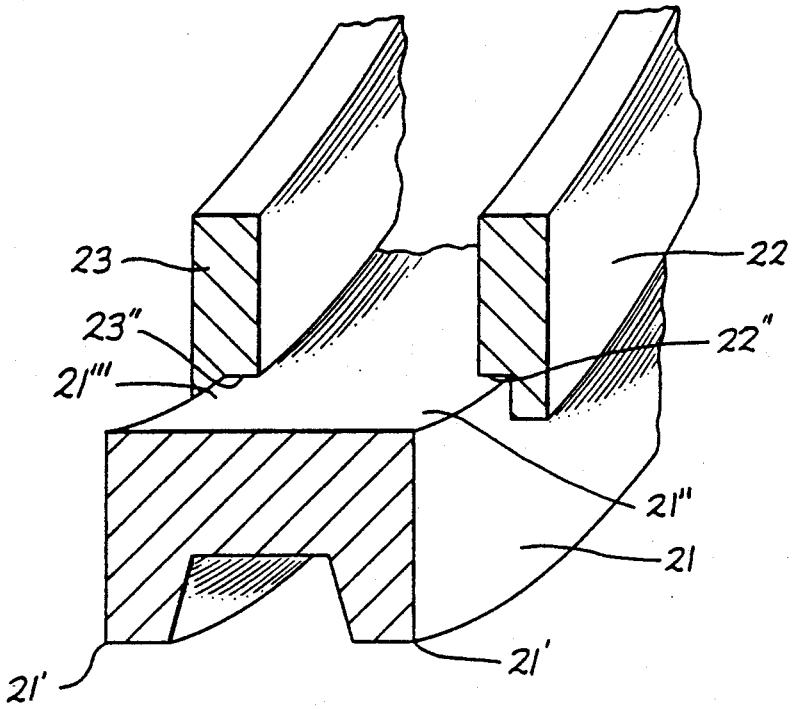

Refer now to FIG. 2 which is a rotated sectional view of a typical casting wheel assembly. Casting wheel assembly 20 comprises a mould member 21 positioned between mounting plate 22 and side plate 23. Mounting plate 22 is secured to side plate 23 by connecting bolt 24. Mounting plate 22 and side plate 23 each have a rabbet 22", 23" respectively in their ring contacting surfaces. (See FIG. 2A). Rabbets 22", 23" cooperate with the inside surfaces 21", 21"' respectively of casting ring 21. When the rabbet 22" of mounting plate 22 and rabbet 23" of side plate 23 engage and cooperate with inside surface 21", 21"', respectively of ring 21, Casting wheel assembly 20 is dimensionally defined. With casting ring 21 so positioned between mounting plate 22 and side plate 23, connecting bolt 24 passes through mounting plate 22 and is secured into threaded hole (not shown) in side plate 23. The compressive force generated by bolt 24 secures casting ring insert 21 between mounting plate 22 and side plate 23 and produces rigid casting ring assembly 20. Casting ring corner 21' extends above the peripheries 23', 22' of mounting plate 22 and side plate 23.

Figure 3:
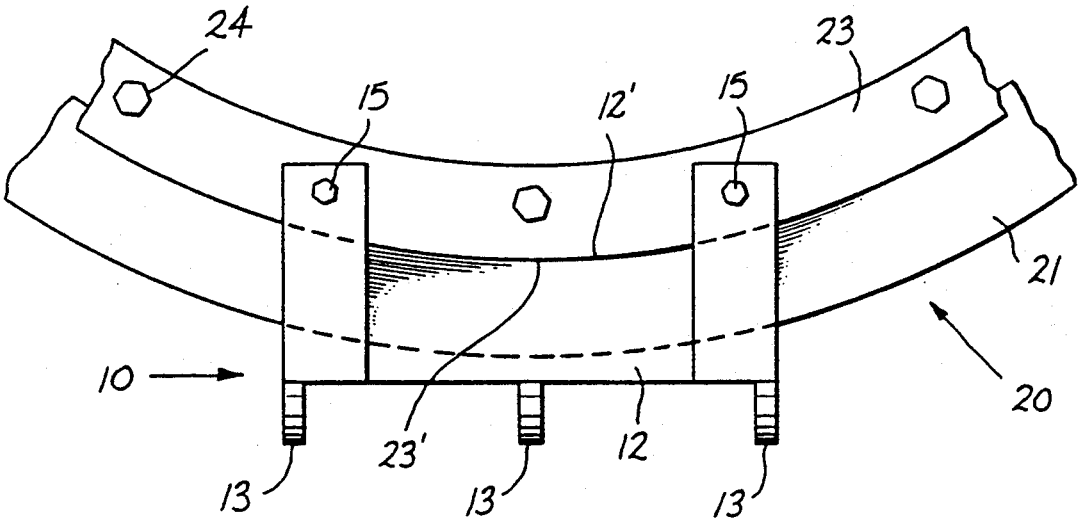
FIG. 3 is a side view illustrating the positioning of the present invention on a casting wheel assembly.

Refer now to FIG. 3 which shows the relative positioning of the present invention 10 on a segment of a typical casting ring assembly 20. Cradle 10 is secured to assembly 20 by bolt (not shown) passing through threaded hole 15 and resting against side plate 23. Outer surface 23' of side plate 23 is in contact with support surface 11' of support member 11. The corresponding surface 22' of mounting plate 22 contacts support surface 12' of support member 12 but are not shown in this view.

Figure 4:
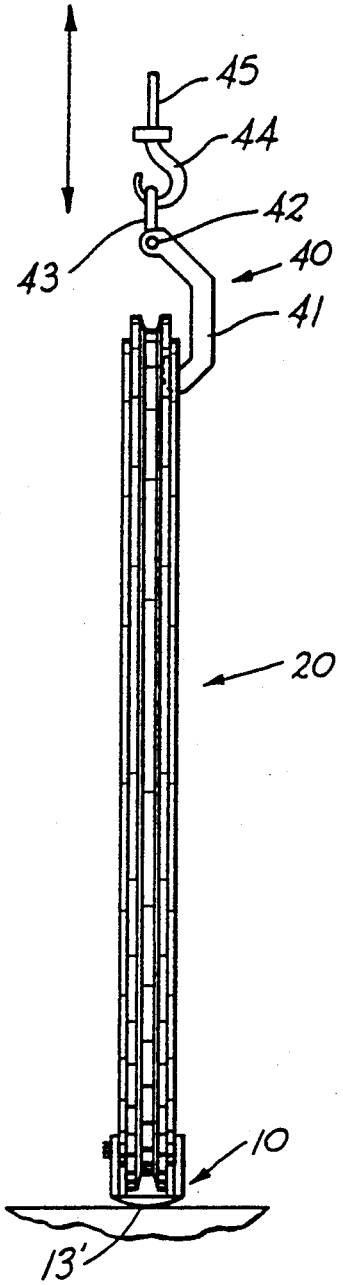
FIG. 4 is a front view of the present invention showing its relative position on a typical casting wheel assembly.

Refer now to FIG. 4 which is a front view of a typical casting ring assembly 20 and the present invention 10 being supported by hook assembly 40. Casting ring assembly 20 is removed from casting machine (not shown) by means of an overhead crane (not shown) and hook assembly 40. Hook 41 is pivotably attached to ring 43 by pivot 42. Crane hook 44 engages ring 43 and as cable 45 is drawn into overhead crane (not shown) casting ring assembly 20 is lifted. Casting ring assembly 20 is placed on a horizontal surface by reversing the above described operation. As cable 45 is paid off of the overhead crane (not shown) casting ring cradle 10 attached to casting ring assembly 20 will contact the vertical surface onto which the assemblies are being placed. Rocker members 13 have radiused contact surfaces 13' and provide convenient means for allowing casting ring assembly 20 to pivot onto its side. As casting wheel assembly 20 pivots from its vertical position to a horizontal position, cradle 10 prevents contacts between mould 21 (see FIG. 2) and the hard horizontal surface. The load generated by the weight of casting wheel assembly 20 is transferred to the mounting plate 22 and side plate 23 (see FIGS. 1, 2, and 3) by support members 11 and 12.

Figure 5:
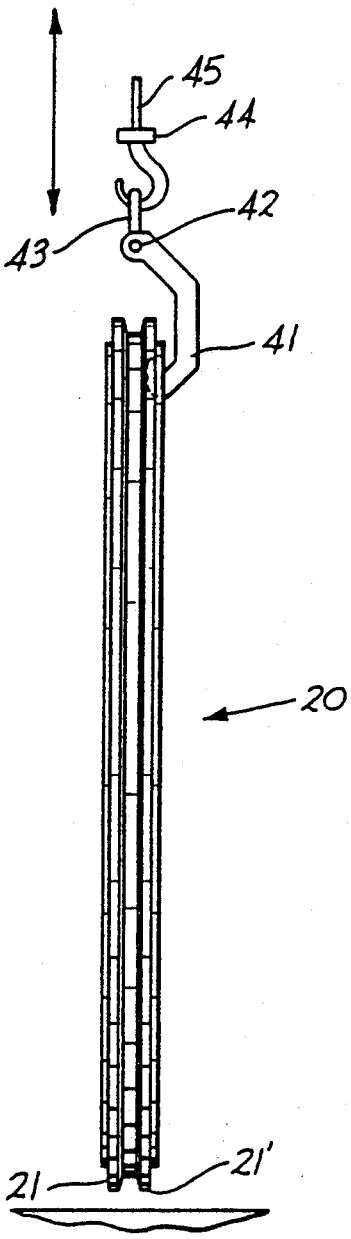
FIG. 5 is a front view of a typical casting wheel assembly without the present invention attached thereto.

Refer now to FIG. 5 which is a front view of a casting ring assembly 20 absent casting ring cradle 10. As cable 45 is fed from overhead crane (not shown) and assembly 20 contacts a horizontal surface, the weight of casting ring assembly 20 will rest on casting ring member 21. With the entire weight of casting ring 20 resting on a small area of the outside of insert 21, insert 21 will develop a flat spot on its periphery in the area contacted by the hard horizontal surface.

Additionally, as casting ring assembly 20 is tipped over in order to place on a horizontal surface, up to half the weight of casting ring assembly 20 rest on corner 21' of casting ring 21. This load applied to the unsupported mould member 21 at corner 21' results in the wall of mould 21 being folded away from the load of the weight of the ring and into the casting chamber.

Although the invention has been discussed and described with primary emphasis on one embodiment, it should be obvious that adaptations and modifications can be made without departing from the spirit and scope of the invention.

What is claimed is:

1. In a combination apparatus which comprises a removably attachable apparatus for receiving, holding, and supporting, and protecting a portion of the periphery of a continuous casting wheel, said wheel comprising a mounting plate, a mould member, and a side plate, while said casting wheel is repositioned from a substantially vertical orientation to a substantially horizontal orientation, the combination apparatus comprising:

a plurality of support members, said members having curved support surfaces, said surfaces contacting and having the same radius as the portion of the periphery of said casting wheel supported by said support surface;

a plurality of fastening means for fastening said apparatus to said casting wheel; and a plurality of curved bases, said bases being attached to said apparatus and said bases permitting said casting wheel to pivot from a vertical position to a horizontal position.

2. The apparatus of claim 1, wherein said support members are dimensioned such that there is no contact between the mould member of the casting wheel and the horizontal surface on which the wheel is rested.

3. The apparatus of claim 1, wherein said fastening means is a threaded bolt.

4. The apparatus of claim 1, wherein said curved bases are dimensioned such that there is an absence of contact between a corner of the mould and the horizontal surface on which the wheel is rested.

5. In a combination apparatus which comprises a cradle for supporting the weight of and protecting the mould of the casting wheel of a continuous casting machine, said wheel comprising a side plate, a casting ring mould, and a mounting plate, such that the mould of said wheel is not damaged when said wheel is rested vertically on a horizontal surface, the combination apparatus comprising:

a plurality of support members, said members having curved support surfaces which engage a portion of the periphery of said casting wheel, said periphery and said curved support surfaces having the same radius;

a plurality of fastening means for fastening said cradle to said casting wheel; and a plurality of rocker members, said members being fixed to said cradle and said members having curved bases such that when said cradle is fastened to said casting wheel, such that when said wheel is stood vertically on a horizontal surface, said wheel can pivot from a vertical position to a horizontal position.

6. The cradle of claim 5, wherein said support members are dimensioned such that when the cradle is fastened to said casting wheel, and said wheel is placed vertically on a horizontal surface, the mould member of said wheel is separated from the horizontal surface.

7. The cradle of claim 5, wherein said fastening means are threaded bolts which secure said cradle to said casting wheel.

8. The cradle of claim 5, wherein said rocker members are dimensioned such that as the wheel is tilted from vertical to horizontal, the mould makes no contact with the horizontal surface.

* * * * *